US011370097B2

(12) United States Patent
Henderson, Jr.

(10) Patent No.: US 11,370,097 B2
(45) Date of Patent: Jun. 28, 2022

(54) STRIKING IMPLEMENT CAP

(71) Applicant: ROMP FASTENERS LLC, Las Vegas, NV (US)

(72) Inventor: Hollis C. Henderson, Jr., Lincolnton, NC (US)

(73) Assignee: ROMP FASTENERS LLC, Las Vegas, NV (US)

( * ) Notice: Subject to any disclaimer, the term of this patent is extended or adjusted under 35 U.S.C. 154(b) by 0 days.

(21) Appl. No.: 17/093,346

(22) Filed: Nov. 9, 2020

(65) Prior Publication Data

US 2022/0143799 A1 May 12, 2022

(51) Int. Cl.
*B25D 1/02* (2006.01)
*B25D 1/12* (2006.01)

(52) U.S. Cl.
CPC ..... *B25D 1/02* (2013.01); *B25D 1/12* (2013.01); *B25D 2250/085* (2013.01); *B25D 2250/105* (2013.01)

(58) Field of Classification Search
CPC ..... B25D 2250/225; B25D 1/02; B25D 1/12; B25D 2250/105; A47C 7/002; A47B 91/06; A47B 91/12; Y10T 16/209; Y10T 4/20828
USPC ..... 81/22, 19, 20, DIG. 12, 25, 26; 248/188.9
See application file for complete search history.

(56) References Cited

U.S. PATENT DOCUMENTS 2,952,284 A * 9/1960 Nichols ..... B25D 1/10 81/19
9,027,891 B2 * 5/2015 Desmarais ..... B60B 33/0042 248/188.9
2009/0293681 A1 * 12/2009 Smith ..... B25D 1/12 81/21
2016/0296076 A1 * 10/2016 Antignane ..... B65D 81/3867

FOREIGN PATENT DOCUMENTS

CA 2341914 * 3/2001
GB 733391 * 7/1955

OTHER PUBLICATIONS https://web.archive.org/web/20181113125438/https:/en.wikipedia.org/wiki/Bevel (Year: 2018).*
Ken-Tool Tire Hammer; retrieved from: https://www.alltiresupply.com/products/kentool-fiberglass-handle-tire-hammer?variant=16348156357 (Year: 2021).*
Gillespie, LaRoux. (2008). Countersinking Handbook—2.1.5 Clearance for Rivets. Industrial Press. Retrieved from https://app.knovel.com/hotlink/pdf/id:kt009ZPOI6/countersinking-handbook/clearance-for-rivets (Year: 2008).*

* cited by examiner

*Primary Examiner* — Mahdi H Nejad
(74) *Attorney, Agent, or Firm* — Maschoff Brennan

(57) ABSTRACT

A striking cap that may include a distal end configured to strike a foreign object. The striking cap may also include a proximal end opposite the distal end. The proximal end may include a protruding ring, where the protruding ring forms a cavity. The cavity may be configured to enable the striking cap to be attached to a striking implement. The proximal medial edge of the protruding ring may include a beveled surface.

10 Claims, 6 Drawing Sheets

STRIKING IMPLEMENT CAP

FIELD

The embodiments discussed in the present disclosure are related to a cap for a striking implement.

BACKGROUND

Striking implements undergo extreme stress on a repeated basis during use. With continued use, the cap of the striking implement may become damaged, unsafe, or unusable. In such circumstances, it may be desired to remove the cap so that a new cap may be installed. In other circumstances, a cap may become dirty such that removal may be desirous for and cleaning, followed by reattaching the cap to the striking implement.

The subject matter claimed in the present disclosure is not limited to embodiments that solve any disadvantages or that operate only in environments such as those described above. Rather, this background is only provided to illustrate one example technology area where some embodiments described in the present disclosure may be practiced.

DESCRIPTION OF EMBODIMENTS

According to one or more embodiments of the present disclosure, a striking implement cap (e.g., a mallet cap for a hammer) may be used with any applicable striking implement as being installed on the portion of the striking implement that strikes a foreign object. As such, the cap may also come in contact with the foreign object when the striking implement is used to strike the foreign object. With repeated use, the cap may become damaged or dirty, such that it may be desired to remove and/or replace the cap. Securely reattaching a cap to a striking implement may be advantageous to limit the likelihood of the cap dislodging during use. A prevailing issue with attaching caps to striking implements is the amount of difficulty introduced by the secure connection between the cap and the striking implement.

The cap of the present disclosure may be used to simplify the attachment between the cap and a striking implement but is not limited to such uses. For example, the cap design of the present disclosure may be used in any tool that implements a replaceable head or cap.

In some embodiments, the cap may be made of rubber, plastic and/or other plastic based materials, nylon, or any other materials configured to provide limited flexibility with durability suitable for a striking implement.

The present embodiments may apply to any cap attached to any striking implement, regardless of the mallet style or weight. A striking implement may include a mallet, a hammer, or any other similar tool designed to strike another object.

Figure 1A:
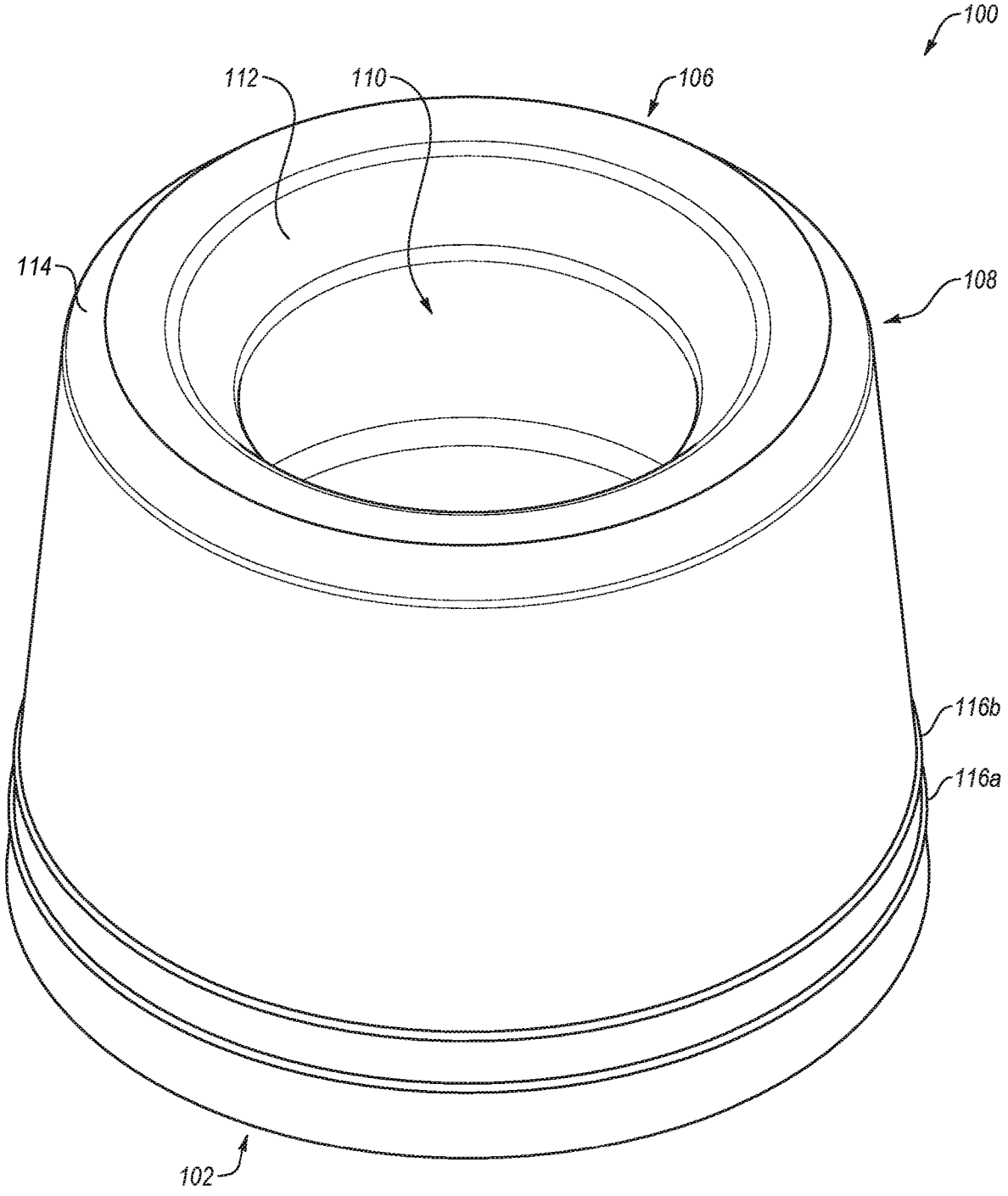
FIG. 1A illustrates an example configuration of a cap, according to at least one embodiment of the present disclosure.
Figure 1B:
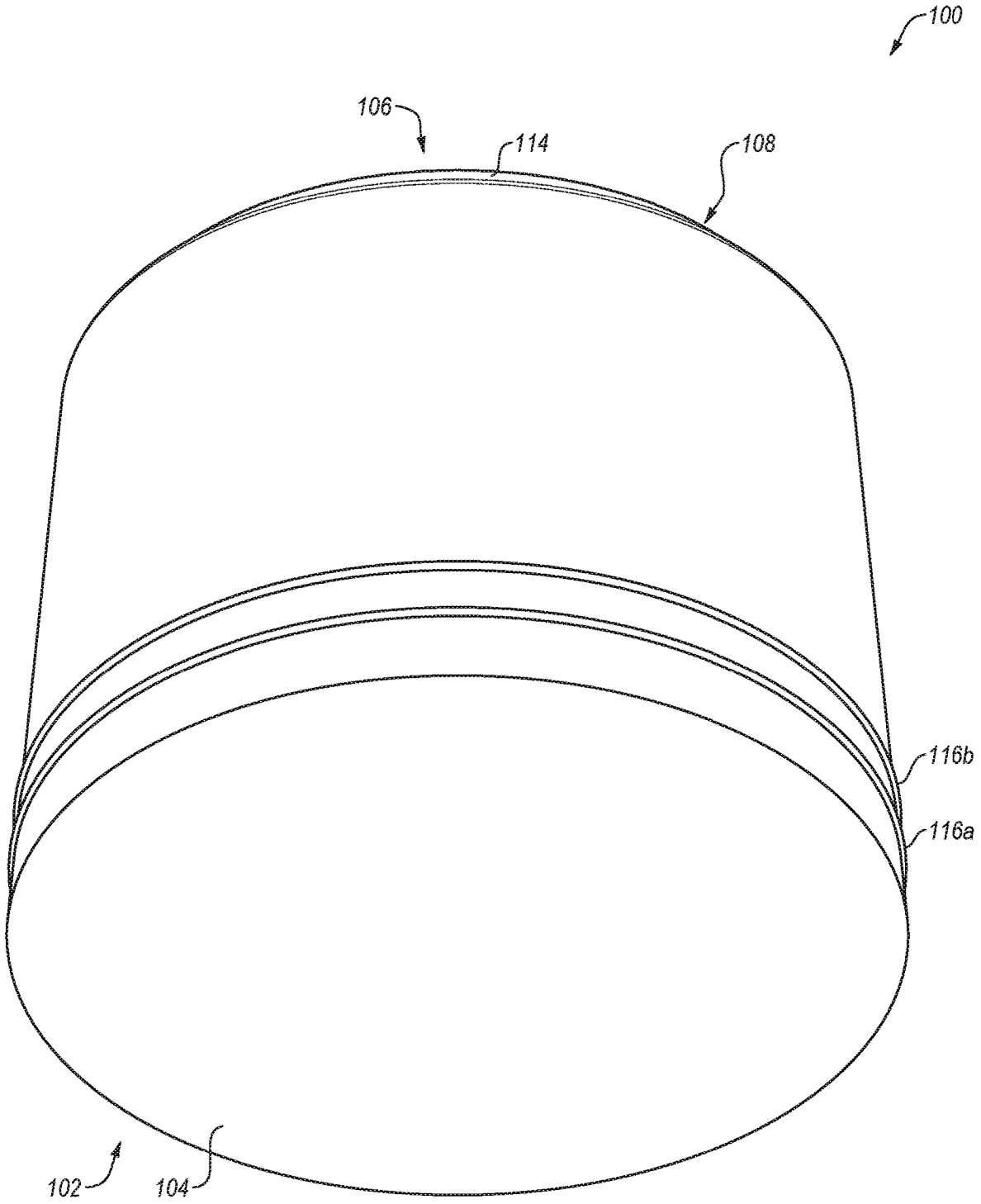
FIG. 1B illustrates a different perspective of an example configuration of a striking implement cap.
Figure 1C:
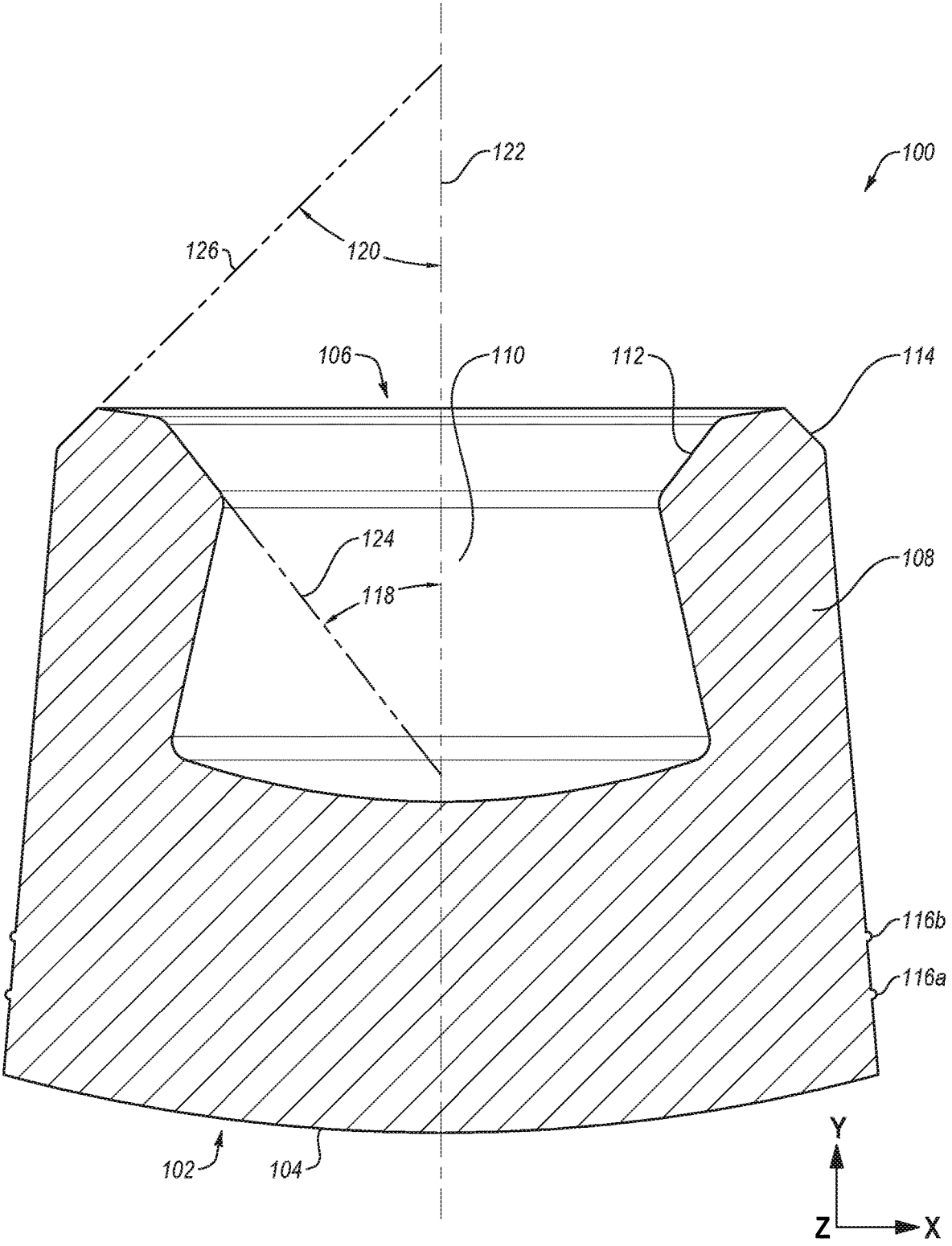
FIG. 1C illustrates a cross-sectional view of a striking implement cap.

FIGS. 1A, 1B, and 1C illustrate an example striking implement cap 100 ("cap 100") according to one or more embodiments of the present disclosure. The cap 100 may be configured to be attached to a striking end of a striking implement. As discussed below, the cap 100 may be configured such that removal and/or attachment of the cap 100 may be easier than with other striking implement caps, while also staying attached to the striking implement during use.

The cap 100 may include a distal end 102. Further, the cap 100 may include a striking face 104 disposed at the distal end 102. The striking face 104 may be configured to strike a foreign object. FIG. 1B displays a different perspective of the cap 100, where the striking face 104 is clearly displayed. In some embodiments, the striking face 104 of the cap may be flat. In some embodiments, the striking face 104 of the cap may be rounded. The striking face 104 may be made of the same material as the cap 100. Alternatively or additionally, the striking face 104 may be made of a different material suitable for striking another object. For example, in some embodiments, the cap 100 may be mostly made of a rubber composition, but the striking face 104 may be made of a metal. The distal end 102 may include a thick portion of material behind the striking face 104. The material behind the striking face 104 may contain the majority of the material of the cap 100. In some embodiments, the material behind the striking face 104 may be one uniform portion of material. Alternatively or additionally, the material behind the striking face may be a composition of materials.

The cap 100 may include a proximal end 106 which is opposite the distal end 102. In some embodiments, the cap 100 may include a protruding ring 108 that extends from the material behind the striking face 104 of the distal end 102. In some embodiments, the protruding ring 108 may form a cavity 110. The cavity 110 may be sized and configured to receive a striking portion of a striking implement such that the striking portion is disposed inside the cavity 110. The cavity 110 is discussed in more detail below with FIG. 1C.

In some embodiments, the protruding ring 108 may include a proximal medial edge 112 disposed at the proximal end 106. The proximal medial edge 112 may have a beveled surface. The beveled surface of the proximal medial edge 112 may enable the cap 100 to be more easily attached to the striking portion of the striking implement. Alternatively or additionally, a proximal lateral edge 110 of the protruding ring 108 that may also be disposed at the proximal end 106 may have a beveled surface. More detail regarding the protruding ring 108, the proximal medial edge 112, and the proximal lateral edge 114 is discussed below with regard to FIG. 1C.

In some embodiments, one or more rings 116 may be included around the distal end 102 of the cap 100. For example, in the illustrated example of FIGS. 1A, 1B, and 1C, the cap 100 may include a first ring 116*a* and a second ring 116*b*, together rings 116. As an example, the first ring 116*a* may be located about 0.25 inches proximally from the distal end 102 of the cap 100. Additionally or alternatively, the second ring 116*b* may be located 0.18 inches proximally from the first ring 116*a*. In the example, both rings may have a diameter of about 0.03 inches.

In some embodiments, the rings 116 may be formed of the same material as the rest of the cap 100. For example, in instances in which the cap 100 is made of rubber, the cap 100 may be formed using a mold that forms the rings 116 also of rubber. Alternatively or additionally, the rings 116 may be a different material. For example, the rings 116 may be made of metal such as iron, steel, tungsten, titanium, or any other similarly suitable material. The rings 116 may provide a user with improved grip when attaching or detaching a cap 100 from a striking implement. Alternatively or additionally, the rings 116 may provide structure to the cap 100, which may help maintain the shape of the cap 100 through repeated use.

In some embodiments, the cap 100 may include a metal ring (not pictured), configured to wrap around the cap 100, in a manner analogous to the rings 116. The metal ring may be in addition to the rings 116, or the metal ring may be in replacement of the rings 116. In some embodiments, the metal ring may be positioned around the cap 100 equidistant from the distal end 102 and the proximal end 106. Alternatively or additionally, the metal ring may be located closer to either of the distal end 102 or the proximal end 106. In some embodiments, the metal ring may be configured to provide a user additional grip that may aid in attaching or detaching the cap 100 to a striking implement.

FIG. 1C illustrates a cross-sectional view of the cap 100. The cross-sectional view of the cap 100 provides another perspective of the distal end 102, the striking face 104, the proximal end 106, the protruding ring 108, the cavity 110, the proximal medial edge 112, the proximal lateral edge 114, and the rings 116. Many of the elements have already been discussed with respect to FIG. 1A and FIG. 1B. However, FIG. 1C provides additional views and insight into the cavity 110, proximal medial edge 112, and the proximal lateral edge 114.

For example, in some embodiments, the width of the distal end 102 may be wider than the width of the proximal end 106. For instance, given the orientation of the cap 100 in FIG. 1C and a Cartesian coordinate system, the distal end 102 of the cap 100 may be wider in the x-direction than the proximal end 106 of the cap 100. Alternatively or additionally, the width of the distal end 102 of the cap 100 may be the same as the width of the proximal end 106 of the cap 100.

In some embodiments, as indicated above, the proximal medial edge 112 may have a beveled surface. The angle of the bevel on the proximal medial edge 112 may be represented by a medial bevel angle 118. Given the orientation of the cap 100, the medial bevel angle 118 may be an angle measured between a cap 100 midline that extends from the distal end 102 to the proximal end 106 and a medial edge line 124 extending from the surface of the proximal medial edge 112. For example, midline 122 may be an example of the cap 100 midline that extends from the distal end 102 to the proximal end 106. In some embodiments, variations in the medial bevel angle 118 may alter the difficulty in attaching the cap 100 to a striking implement. For example, a steep medial bevel angle 118, (e.g., the y-component of the bevel is greater than the x-component of the bevel) on the proximal medial edge 112 may make attaching the cap 100 to a striking implement easier. In another example, a shallow medial bevel angle 118 (e.g., the x-component of the bevel is greater than the y-component of the bevel) on the proximal medial edge 112 may make attaching the cap 100 to a striking implement more difficult. In some embodiments, a steep medial bevel angle 118 may be easier to attach in exchange for a less secure connection between the cap 100 and a striking implement. Alternatively or additionally, a shallow medial bevel angle 118 may be more difficult to attach the cap 100 to a striking implement, but may enable a more secure connection between the cap 100 and the striking implement. In some embodiments, the amount of bevel in the steep bevel may vary in slope up to the point where the angle of the bevel is parallel with the interior wall of the protruding ring 108. In some embodiments, the amount of bevel in the shallow bevel may vary in slope up to the point where the angle of the bevel is perpendicular with the interior wall of the protruding ring 108. In some embodiments, the medial bevel angle 118 may be between 35 and 40 degrees. For example, in some embodiments, the medial bevel angle 118 may be 38 degrees.

In some embodiments, the beveled surface of the proximal medial edge 112 may vary depending on the type of implement to which the cap 100 is configured to attach. For example, a large square-like striking implement, like a sledgehammer, may have a steep medial bevel angle 118, corresponding to the profile of the sledgehammer. In another example, a hammer with a head attached to a narrow neck may have a shallow medial bevel angle 118 that may securely attach to the striking implement. In some embodiments, the beveled surface of the proximal medial edge 112 may vary based on the size of the cap 100. For example, the medial bevel angle 118 may be steep in a smaller sized cap 100, like a cap for a one- to two-pound flooring mallet, where the cap 100 may be less flexible and more difficult to manipulate. In another example, the medial bevel angle 118 may be shallow in a larger cap 100, like a cap for a three- to five-pound flooring mallet, where the cap 100 may be more flexible and easier to manipulate.

In some embodiments, the amount of bevel of the proximal medial edge 112 may be tied to the type of material of which the cap 100 is comprised. For example, a cap 100 comprised of a more pliable material may include a shallow medial bevel angle 118 on the proximal medial edge 112. This may combine the difficulty of the shallow bevel with the flexibility of the pliable material to make attaching a cap 100 to a striking implement less difficult. In another example, a cap 100 comprised of a more rigid material may include a steep medial bevel angle 118 on the proximal medial edge 112. This may combine the ease of attaching the steep bevel with the inflexibility of the rigid material to make attaching a cap 100 to a striking implement less difficult.

In some embodiments, the proximal medial edge 112 may include a smooth surface. The smooth surface may promote easier attachment of the cap 100 to a striking implement. The smooth surface may be in comparison to the other surfaces of the cap 100. In some embodiments, the smooth surface of the proximal medial edge 112 may include a processed finish on the material of which the cap 100 is comprised. For example, a cap 100 may be comprised of a rubber material. The proximal medial edge 112 of the cap 100 may be polished to allow an easier attachment of the cap 100 to a striking implement. Alternatively or additionally, the proximal medial edge 112 may be comprised of a material different than the rest of the cap 100, the different material promoting an easier attachment of the cap 100 to a striking implement. For example, a cap 100 may be comprised of a first type of rubber. The proximal medial edge 112 may be comprised of a second type of rubber, the second type of rubber having more permissive properties than the first type of rubber, where the permissive properties may promote easier attachment of the cap 100 to a striking implement.

Alternatively or additionally, the proximal lateral edge 114 may have a beveled surface. The angle of the bevel on the proximal lateral edge 114 may be represented by lateral bevel angle 120. Given the orientation of the cap 100, the lateral bevel angle 120 may be an angle measured between a cap 100 midline that extends from the distal end 102 to the proximal end 106 and a lateral edge line 126 extending from the surface of the proximal lateral edge 114. For example, midline 122 may be an example of the cap 100 midline that extends from the distal end 102 to the proximal end 106. In some embodiments, the lateral bevel angle 120 may be between 40 and 50 degrees. For example, in some embodiments, the lateral bevel angle 120 may be 45 degrees. In some embodiments, the proximal medial edge 112 may include a greater length of bevel than the proximal lateral edge 114. For example, given the orientation of the cap of FIG. 1C and a Cartesian coordinate system, the amount of bevel on the proximal medial edge 112 in the x-direction may be greater than the amount of bevel on the proximal lateral edge 114 in the x-direction. Similarly, given the orientation of the cap of FIG. 1C and a Cartesian coordinate system, the amount of bevel on the proximal medial edge 112 in the y-direction may be greater than the amount of bevel on the proximal lateral edge 114 in the y-direction.

In some embodiments, the cavity 110 may be formed by the protruding ring 108 extending from the distal end 102. In some embodiments, the cavity 110 may be configured to attach the cap 100 to a striking implement head. The cavity 110 may have a distal portion that is opposite the opening of the cavity 110. The distal portion of the cavity 110 may be rounded. Alternatively or additionally, the distal portion of the cavity 110 may be flat. In some embodiments, the distal portion of the cavity 110 may be vary with respect to the striking implement to which the cap 100 is configured to attach. In some embodiments, the cavity 110 may taper from the opening to the distal portion of the cavity 110. For example, given the orientation of the cap of FIG. 1C and a Cartesian coordinate system, the width in the x-direction of the distal portion of the cavity 110 may be greater than the width of the opening of the cavity 110 in the x-direction. The degree of taper in the cavity 110 may vary based on the type of striking implement to which the cap 100 is intended to attach. For example, a cap 100 configured to attach to a sledgehammer may have a small taper in the cavity 110 to accommodate the square head of the sledgehammer. In another example, a cap 100 configured to attached to a claw hammer, may have a large taper in the cavity 100 to accommodate a larger contour in the head of the hammer.

In an example embodiment using the orientation of the cap in FIG. 1C and a Cartesian coordinate system, the width of the distal end of a cap in the x-direction may be 2.71 inches. The width of the proximal end in the x-direction, which may be tapered from the distal end, may be 2.32 inches. The amount of bevel in the proximal lateral edge may be 0.125 inches in the x-direction and may be 0.125 inches in the y-direction. The amount of bevel in the proximal medial edge may be 0.195 inches in the x-direction and may be 0.25 inches in the y-direction. Specific spacing, taper, and bevel amounts may vary depending on the type of striking implement with which the cap is used.

Figure 1D:
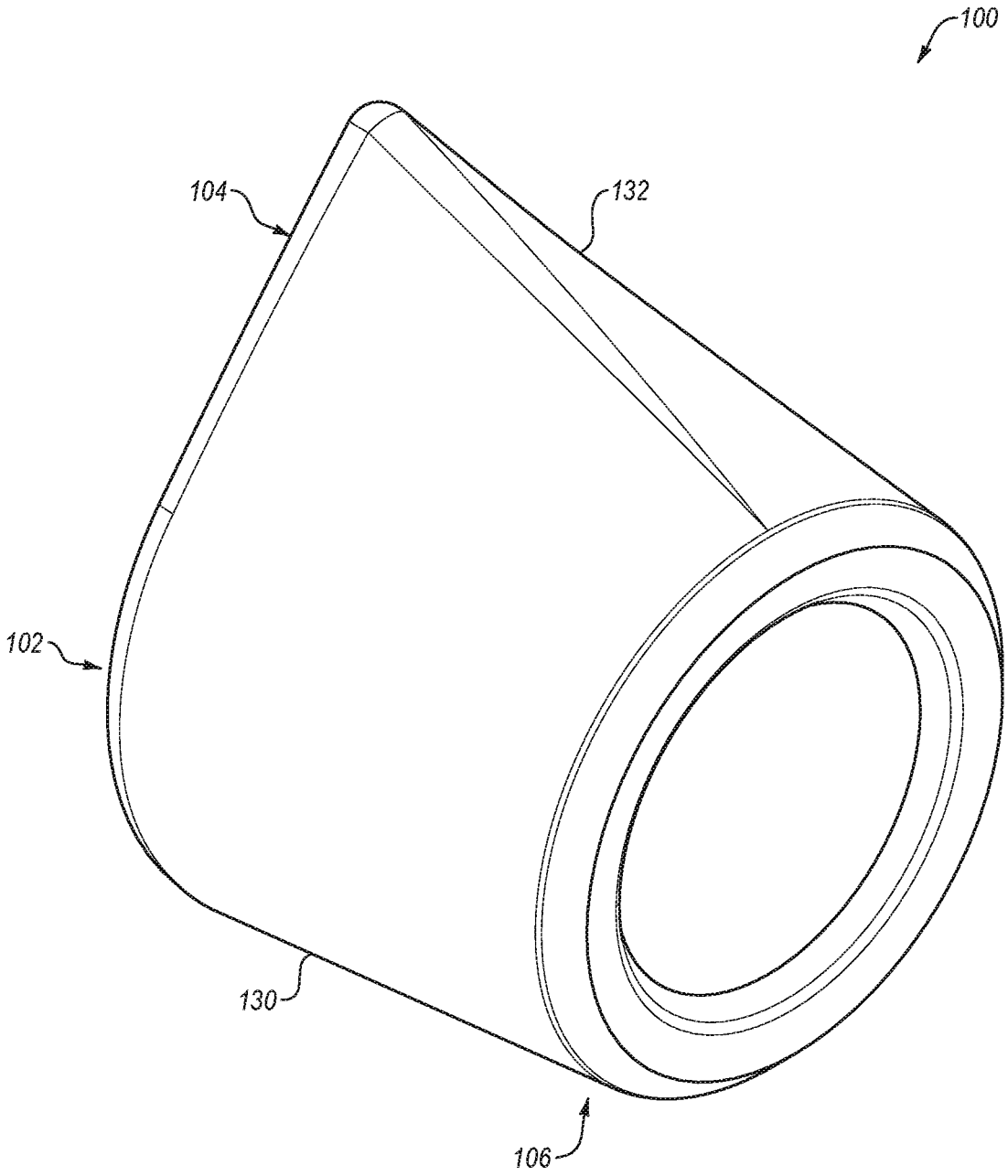
FIG. 1D illustrates an asymmetrically shaped striking implement cap.

FIG. 1D illustrates an asymmetrically shaped cap 100. In some embodiments, the asymmetrically shaped cap 100 may have a first external edge 130 and a second external edge 132. In some embodiments, the first external edge 130 may be marginally shorter or substantially equal in length compared to the second external edge 132. Alternatively or additionally, the first external edge 130 may be significantly shorter in length compared to the second external edge 132.

In some embodiments, the first external edge 130 and the second external edge 132 may extend away from the proximal end 106 at substantially the same angles. The first angle may be measured between the first external edge 130 and plane formed by the end most points of the proximal end 106. The second angle may be measured between the second external edge 130 and plane formed by the end most points of the proximal end 106. In these and other embodiments, the cap 100 may be asymmetric when the first external edge 130 is a different length than the second external edge 132. Alternatively or additionally, the cap 100 may be asymmetric when the length of the first external edge 130 is the same or substantially similar to the length of the second external edge 132, but the first angle related to the first external edge 130 differs in degrees from the second angle related to the second external edge 132. In some embodiments, the striking face 104 on the distal end 102 of the cap 100 that is asymmetrically shaped may be flat or rounded.

Modifications, additions, or omissions may be made to the cap 100 of FIGS. 1A, 1B, and 1C without departing from the scope of the present disclosure. For example, as indicated above, the type of materials used to form the cap 100 may vary. Further, the cap 100 may be made of a uniform material or two or more different materials. In addition, the dimensions and/or shapes of the cap 100 may vary greatly depending on the particular striking implement for which the cap 100 may be configured. Alternatively, or additionally, the number of rings 114 illustrated and described is merely given as an example and is not meant to be limiting. In addition, the shape of the cap 100 may vary from the above described symmetric and asymmetrically shaped caps 100.

Figure 2A:
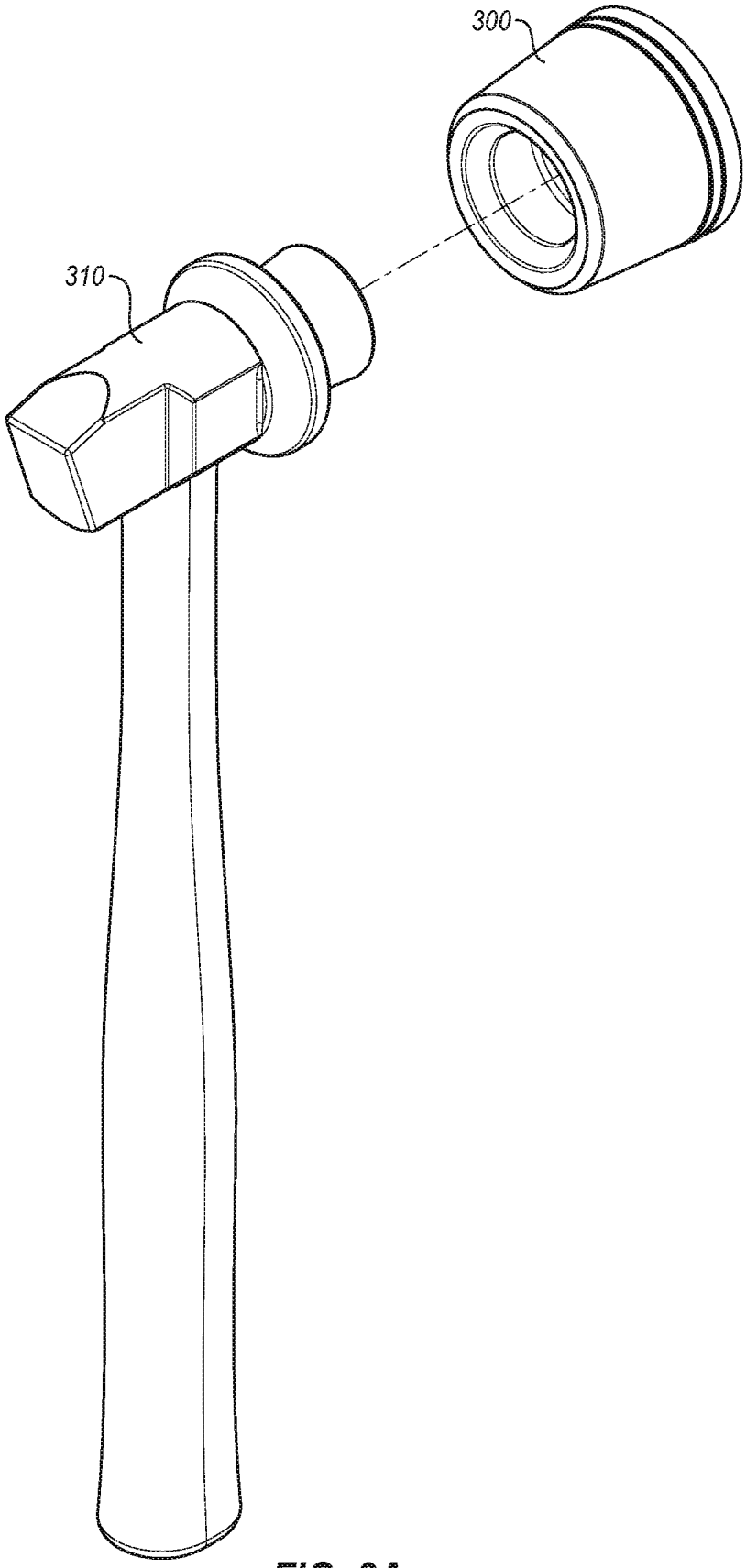
FIG. 2A illustrates a cap and a striking implement, prior to the cap attaching to the striking implement.
Figure 2B:
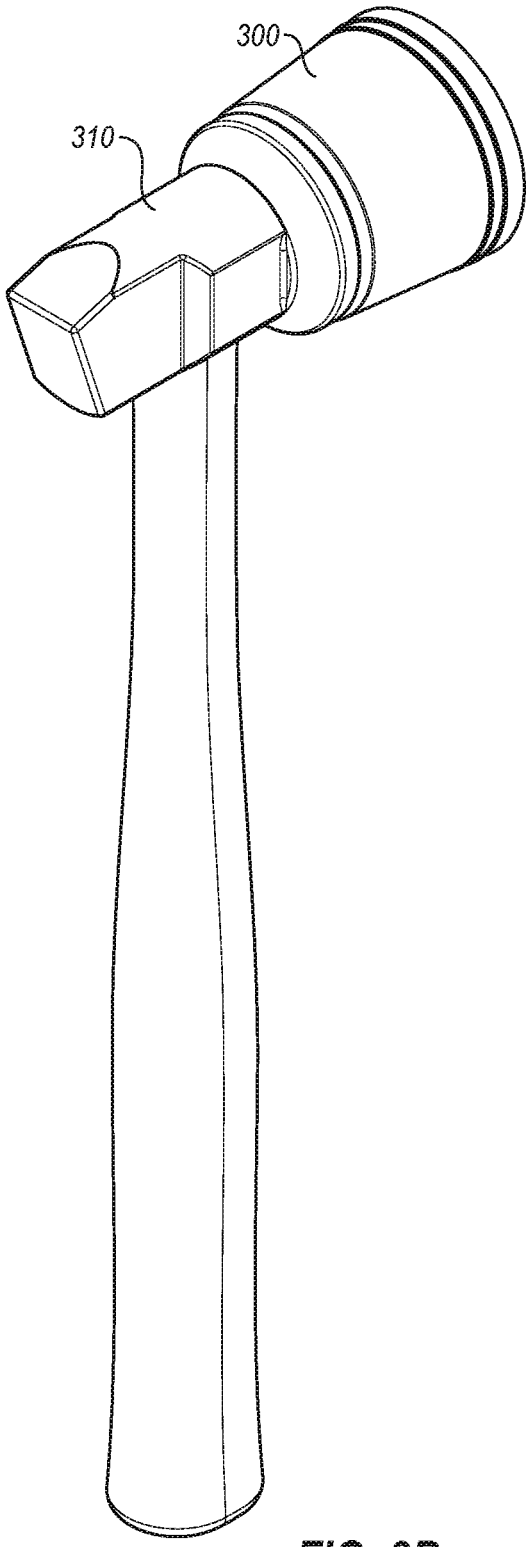
FIG. 2B illustrates a cap attached to a striking implement.

FIG. 2A and FIG. 2B illustrate a cap 300 and a striking implement 310 prior to attachment and attached, respectively. The cap 300 may be an example of the cap 100 of FIGS. 1A, 1B, and 1C. As indicated above, in some embodiments, the specific size, shape, amount of taper, amount of bevel, etc. may vary in the cap 100 depending on the type of striking implement 310 to which it is configured to attach.

In some embodiments, when attaching the cap 300 to the striking implement 310, the head of the striking implement may first contact a protruding ring of the cap 300. The protruding ring may be sized such that the diameter of an opening of a cavity formed by the protruding ring is smaller than the diameter of the head of the striking implement 310. For example, a cap 300 may have an opening to a cavity that is approximately 1.34 inches in diameter. Continuing the example, a striking implement 310 may have a head that has a diameter of approximately 1.73 inches in diameter. In some embodiments, a beveled surface on a proximal medial edge of the cap 300 may contact the striking implement 310 prior to the cap 300 attaching to the striking implement 310. The beveled surface of the proximal medial edge of the cap 300 may enable the striking implement 310 to more easily slide into the cavity of the cap 300, wherein the cavity may be configured to receive the striking implement 310. In some embodiments, pressing the striking implement 310 into the bevel surface may cause the opening of the cap 300 to expand, which may enable the cap 300 to attach to the striking implement 310. For example, in the example where an opening of a cavity of a cap 300 is smaller than the head of a striking implement 310, pressing the striking implement 310 into the bevel on the proximal medial edge of the cap 300 may expand the opening of the cap 300, which may aid in the attachment between the cap 300 and the striking implement 310.

Modifications, additions, or omissions may be made to the cap 300 or the striking implement 310 of FIGS. 2A and 2B without departing from the scope of the present disclosure. For example, the dimensions and/or shapes of the cap 300 may vary greatly depending on the particular striking implement 310 for which the cap 300 may be configured. Alternatively or additionally, the type of striking implement 310 illustrated is merely given an example and is not meant to be limiting.

With respect to the use of substantially any plural or singular terms herein, translating from the plural to the singular or from the singular to the plural may be performed as is appropriate to the context or application. The various singular/plural permutations may be expressly set forth herein for sake of clarity. A reference to an element in the singular is not intended to mean "one and only one" unless specifically stated, but rather "one or more." Moreover, nothing disclosed herein is intended to be dedicated to the public regardless of whether such disclosure is explicitly recited in the above description.

In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). Furthermore, in those instances where a convention analogous to "one or more of A, B, and C", "at least one of A, B, and C", "one or more of A, B, or C" "at least one of A, B, or C, etc." is used, in general, such a construction is intended to generally have a disjunctive interpretation (e.g., "a system having at least one of A, B, or C" or "a system having at least one of A, B, and C" would include but not be limited to systems that include A alone, B alone, C alone, A and B together, A and C together, B and C together, or A, B, and C together, etc.). Also, a phrase presenting two or more alternative terms, whether in the description, claims, or drawings, should be understood to include one of the terms, either of the terms, or both terms. For example, the phrase "A or B" will be understood to include the possibilities of "A" or "B" or "A and B." This interpretation of the phrase "A or B" is still applicable even though the term "A and/or B" may be used at times to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements.

The present invention may be embodied in other specific forms without departing from its spirit or essential characteristics. The described implementations are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A striking cap, comprising:

a distal end configured to strike a foreign object, the distal end having a first external surface and a first external diameter; and a proximal end comprising a protruding ring having a second external surface and a second external diameter, the protruding ring forming a cavity configured to attach to a striking implement head, the cavity including a first diameter, a second diameter, a third diameter, and a fourth diameter, wherein:

the second external surface includes a beveled surface on a proximal lateral edge thereof, the beveled surface configured to receive a metal ring, wherein the metal ring is configured to wrap around the striking cap to provide additional grip to a user that may aid in attaching or detaching the striking cap to the striking implement, the first diameter is larger than the second diameter, the third diameter, and the fourth diameter, the fourth diameter is smaller than the second diameter and larger than the third diameter, the first diameter is disposed at an opening of the cavity and the fourth diameter is disposed at a closed distal portion of the cavity, the cavity includes a first portion between the first diameter and the second diameter, the first portion being continuously tapered from the first diameter to the second diameter at a first slope, the cavity includes a second portion between the second diameter and the third diameter, the second portion being continuously tapered from the second diameter to the third diameter at a second slope that is greater than the first slope;

the cavity includes a third portion between the third diameter and the fourth diameter, the third portion being continuously tapered from the fourth diameter to the third diameter at a third slope that is greater than the second slope; and the first external diameter is greater than the second external diameter.

2. The striking cap of claim 1, further comprising a striking face attached to the distal end, the striking face configured to contact a foreign object.

3. The striking cap of claim 2, wherein the striking face is rounded.

4. The striking cap of claim 1, further comprising a plurality of rings disposed on the distal end, the plurality of rings encasing the distal end of the striking cap.

5. The striking cap of claim 1, wherein the striking cap is composed of a uniform type of material.

6. The striking cap of claim 1, wherein the second portion is composed of a distinct material from the rest of the striking cap.

7. The striking cap of claim 1, wherein an angle of the second portion is configured to be between 35 and 40 degrees measured between a striking cap midline extending from the distal end to the proximal end and a line extending from the surface of the second portion.

8. The striking cap of claim 1, wherein an angle of the second portion corresponds to a striking implement to which the striking cap is configured to attach.

9. The striking cap of claim 1, wherein an angle of the second portion corresponds to a size of the striking cap.

10. The striking cap of claim 1, wherein an angle of the second portion corresponds to a material that composes the striking cap.

* * * * *